US010458658B1

(12) United States Patent
Bradfield

(10) Patent No.: US 10,458,658 B1
(45) Date of Patent: Oct. 29, 2019

(54) PORTABLE COOKING STATION

(71) Applicant: Gerald E. Bradfield, Glens Falls, NY (US)

(72) Inventor: Gerald E. Bradfield, Glens Falls, NY (US)

( * ) Notice: Subject to any disclaimer, the term of this patent is extended or adjusted under 35 U.S.C. 154(b) by 237 days.

(21) Appl. No.: 15/792,864

(22) Filed: Oct. 25, 2017

(51) Int. Cl.

| | |
|---|---|
| ***F24C 3/08*** | (2006.01) |
| ***F24C 15/10*** | (2006.01) |
| ***F24C 3/14*** | (2006.01) |
| *A47K 1/05* | (2006.01) |
| *F24C 3/00* | (2006.01) |

(52) U.S. Cl.
CPC ..... *F24C 3/085* (2013.01); *A47K 1/05* (2013.01); *F24C 3/008* (2013.01); *F24C 3/14* (2013.01); *F24C 15/10* (2013.01)

(58) Field of Classification Search
CPC ..... F24C 3/08; F24C 3/14; F24C 15/10
USPC ..... 126/40
See application file for complete search history.

(56) References Cited

U.S. PATENT DOCUMENTS 3,289,664 A * 12/1966 Hewitt ..... A47B 77/08 126/37 R
3,915,529 A * 10/1975 Bernier ..... A47B 3/10 312/237
D283,589 S * 4/1986 Erlandson ..... D7/347
4,878,477 A * 11/1989 McLane ..... A47J 37/0704 126/41 R
4,886,045 A * 12/1989 Ducate, Jr. ..... A47J 37/0713 126/41 R
5,315,983 A * 5/1994 Law ..... F24C 15/10 126/214 D
5,775,316 A 7/1998 Jones
6,186,055 B1 2/2001 DeMars et al.
6,437,297 B2 * 8/2002 Weiss ..... A47B 77/02 219/452.12
6,543,436 B2 * 4/2003 Montgomery ..... F24C 3/14 126/305
6,718,967 B2 4/2004 Luther
6,883,881 B2 * 4/2005 Gauss ..... A47F 9/00 108/152
7,121,274 B2 * 10/2006 Wishart ..... A47B 43/00 126/57
7,201,458 B2 * 4/2007 DeMars ..... A47J 37/0781 126/25 R
8,820,313 B1 9/2014 Lutes
9,089,210 B2 * 7/2015 Kool ..... A47B 31/02
(Continued)

OTHER PUBLICATIONS

B+S Black Noodle Cooker. Product listing [online]. B&S Commercial Kitchens, [retrieved on Jun. 13, 2017]. Retrieved from the Internet: <URL: https://www.bscommercialkitchens.com/bs-range-asian/>.

*Primary Examiner* — Edelmira Bosques
*Assistant Examiner* — Nikhil P Mashruwala
(74) *Attorney, Agent, or Firm* — Cramer Patent & Design, PLLC; Aaron R. Cramer

(57) ABSTRACT

A portable cooking station includes a work table having an upper work surface, a storage area disposed beneath the upper work surface and a caster wheel supporting each leg of the table. A gas burner having a plurality of nozzles arrayed in a circle and within a ring is disposed within the upper work surface. A faucet having an extendable fill arm and basin is disposed adjacent the gas burner. A control panel concentrates the burner assembly controls.

9 Claims, 5 Drawing Sheets

(56) References Cited

U.S. PATENT DOCUMENTS

| | | | | |
|---|---|---|---|---|
| 2008/0156311 | A1* | 7/2008 | Mac | F24C 3/085<br>126/40 |
| 2008/0245357 | A1* | 10/2008 | Meether | A47J 37/0704<br>126/25 R |
| 2011/0041707 | A1* | 2/2011 | Delgadillo | F24C 15/10<br>99/422 |

* cited by examiner

PORTABLE COOKING STATION

RELATED APPLICATIONS

Not applicable.

FIELD OF THE INVENTION

The present invention relates generally to a portable cooking station.

BACKGROUND OF THE INVENTION

Spending time in the great outdoors is among the most popular fair-weather leisure time activities. Quite often, cooking and eating a meal is made part of the outdoor activity. Whether it is a family gathering, at a picnic or just having a cookout, a great deal of time is centered on the preparation and consumption of food. Most people commonly associate the use of a barbeque grill with outdoor cooking, however, cultural tastes run wide and there are a wide variety of foods from different cuisines that can be enjoyed outdoors as well. The taste of true Asian food is a favorite of many, but since many of these foods are prepared in a wok, the ability to enjoy them in an outdoor environment is limited. Additionally, Asian food prepared on an indoor wok in a residential environment suffers due to the lack of high heat availability which is limited by regulations. Thus, even with everything else being equal, food quality, technique, chef skill and the like, the special nuanced flavor associated with true Asian cuisine cannot be achieved.

Attempts in the past of been made to provide such portable cooking stations. U.S Pat. App. Pub. No. 2011/0041707 in the name of Delgadillo, U.S. Pat. No. 5,775,316 in the name of Jones, U.S. Pat. App. Pub. No. 2008/0156311 in the name of Mac, U.S. Pat. No. 8,820,313 in the name of Lutes, and the B&S Black Waterless Wok Cooker.

Accordingly, there exists a need for a means by which food may be cooked in a wok in an outdoor setting in an effort to address the concerns outlined above. The development of the mobile cooking wok fulfills those needs.

SUMMARY OF THE INVENTION

The principles of the present invention provide for a cooking station device that is portable, easy to use, sanitary, and provides enhanced cooking capabilities.

An object of such an invention includes a table assembly that further has an upper table, defining an upper first side and an upper second side, a lower table defining a lower first side and a lower second side, four (4) first leg segments, each having a first end connected to the upper second side and each having a second end connected to the lower first side, four (4) second leg segments, each located immediately subjacent to an individual one (1) of and coaligned with the four (4) first leg segments, a first end of each second leg segment attached to the lower second side, and a caster wheel assembly disposed on second ends of each second leg segment. A sink assembly is mounted within the upper table, the basin is accessible from the upper first side. A burner assembly with a wok ring integrated therewith is mounted within the upper table and accessible from the upper first side. A control panel is in electrical and fluid communication with the burner assembly and affixed to a sidewall of the upper table. In other embodiments, a vessel is nested within a mounting plate that is affixed to the upper table.

Another object of the portable cooking station is providing the first leg segment second ends and said second leg segment first ends to be located at a corner of the lower table. Other preferred embodiments, provide for the table assembly to have a stainless steel construction. Still yet other embodiments provide for each caster wheel to enjoy three hundred sixty degrees (360°) of rotation.

A further object of the sink assembly incorporates a faucet affixed to the basin and extending upward from the upper first side, a first valve in fluid communication with the faucet, a second valve located on the faucet and in fluid communication therewith, a water supply hose configured to be in fluid communication between a water supply and the second valve, a drain fixture located at a bottom of the basin, and a drain hose configured to be in fluid communication with the first valve. In certain embodiments, the faucet is a retractable folding faucet, capable of extension directly over the burner assembly.

A further object of the burner assembly includes a ring affixed to the upper first side, configured to support a cooking vessel thereon, a flue chamber capable of being removably attached to the upper first side, a mounting bar affixed to the flue chamber, a plurality of burner nozzles, each in fluid communication with a fuel source and each capable of producing a flame, each further attached to the mounting bar, and a concentration cone attached to the mounting bar and oriented to direct the flames from each nozzle towards a center of the ring. In a preferred embodiment, the burner assembly has sixteen (16) nozzles. The burner in a preferred embodiment is capable of producing approximately one hundred thousand British Thermal Units (1000,000 BTU's).

A further object of the control panel, is to provide a main burner supply line in fluid communication with each burner nozzle, a main valve in fluid communication with the burner piping, a pilot supply line in fluid communication with each burner nozzle and terminating in a pilot orifice, a striker located adjacent the pilot orifice, a piezo electric ignition switch in electrical communication with the striker, a pilot valve in fluid communication with the pilot supply line opposite said pilot orifice, a supply line capable of being in fluid communication between a fuel source and the main valve and pilot valve, and a regulator in fluid communication with the supply line.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
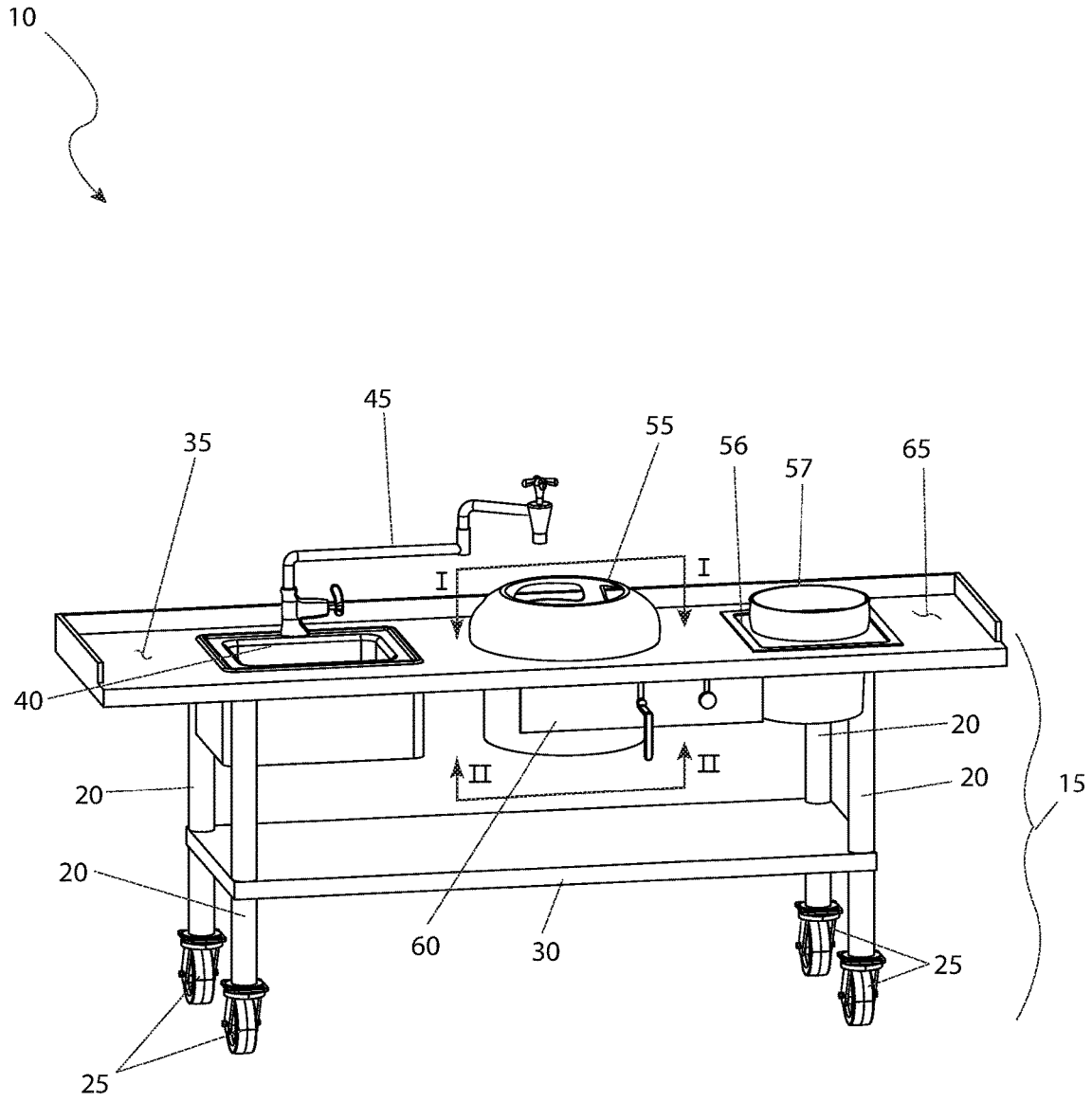
FIG. 1 is a perspective view of the mobile cooking wok 10, according to the preferred embodiment of the present invention.

10 mobile cooking wok
15 work table
20 leg
25 rotatable caster
30 lower utility surface
35 work surface
40 sink assembly
45 faucet
50 burner assembly
55 wok ring
56 mounting plate
57 oil pot
60 control panel
65 auxiliary work surface
70 sink basin
75 water hose connection
80 drain waste hose
85 drain fixture
90 fuel hose
95 regulator
100 wok-style cooking pan
105 gas pilot valve
110 piezo electric ignition switch
115 gas valve handle
120 main gas valve
125 primary valve
130 secondary valve
135 concentration cone
140 mounting bar
145 wok flue/chamber
155 right angle clip
160 gas pilot supply line
165 gas pilot orifice
170 piezo electric striker
175 gas burner piping

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

Referring now to FIG. 1, a front view of the mobile cooking wok 10, according to the preferred embodiment of the present invention is disclosed. The mobile cooking wok 10 (herein also described as the "apparatus") 10, includes a work table 15, envisioned to be made of stainless steel following that of a heavy duty commercial design, complete with four (4) legs 20, four (4) casters 25, each capable of three hundred sixty degree (360°) rotation (only two (2) of which are shown due to illustrative limitations), and a lower utility surface 30. The work table 15 has the approximate dimensions of sixty inches (60 in.) long, thirty-six inches (36 in.) tall, and twenty-four inches (24 in.) deep. The rotatable casters 25 are each of a heavy-duty design and are approximately five inches (5 in.) in diameter to allow them to traverse over small objects and/or rough surfaces with ease. A first side (herein illustrated as the left side) of the work surface 35 is provided with a sink assembly 40 complete with a faucet 45. Further description of the sink assembly 40 and faucet 45 will be provided herein below. The center of the work surface 35 is provided with a burner assembly 50 (not shown due to illustrative limitations) and a wok ring 55. Further description of the burner assembly 50 and the wok ring 55 will be provided herein below.

The wok ring 55 is approximately sixteen inches (16 in.) in diameter with a throat opening of approximately twelve inches (12 in.) in diameter. A control panel 60 is located on the front of the work table 15, located directly below the wok ring 55. Components located on the control panel 60 will be described in greater detail herein below.

To the right of the wok ring 55 is a mounting plate 56 that is affixed to the work surface 35. The mounting plate 56 has a center circular cutout that aligns with a similar shaped and sized cut-out in the work surface 35. An oil pot 57 that has a generally tapering sidewall, an open top, and a bottom is capable of nesting within the mounting plate 56, such that an upper portion of the oil pot 57 resides above the surface 35 and the majority of the oil pot 57 is suspended by the mounting plate 56 below the work surface 35, yet does not interfere with the lower utility surface 30. The mounting plate 56 is preferably tack welded to the work surface 35. The oil pot 57 is approximately eight inches (8 in.) in height. An auxiliary work surface 65 is located on the right side of the work surface 35 and to the right of the mounting plate 56 for general purposes associated with pre- or post-preparation associated with foods cooked on the apparatus 10. It should be noted that the apparatus 10 is intended for outdoor use only due to the high thermal heat output (approximately one hundred thousand British thermal units (100,000 BTU)) associated with the burner assembly 50 as well as excess combustion. Local laws and regulations may limit its use to patios, decks, and similar areas.

Figure 2:
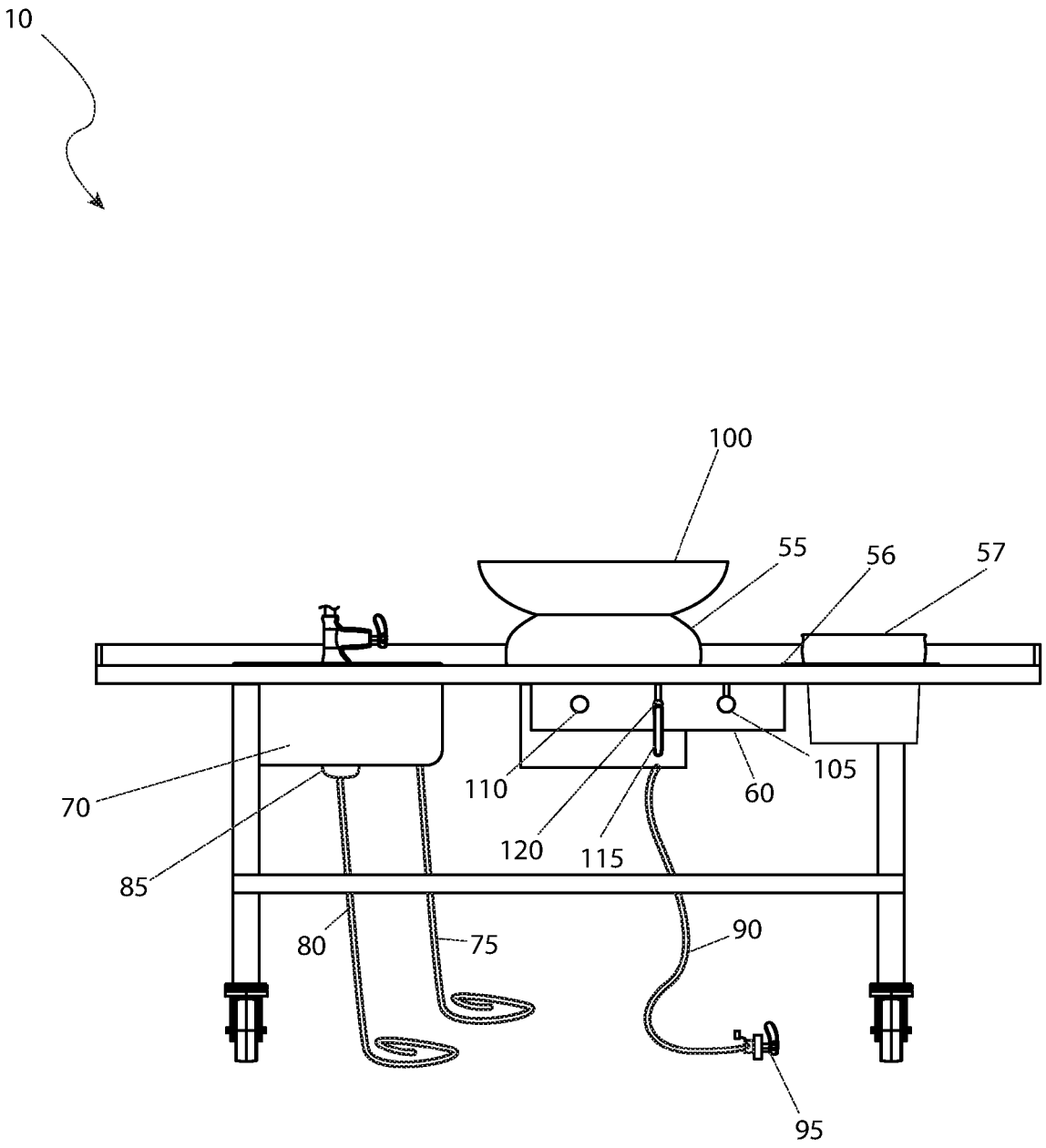
FIG. 2 is a front view of the mobile cooking wok 10, according to the preferred embodiment of the present invention.

Referring next to FIG. 2, a front view of the apparatus 10, according to the preferred embodiment of the present invention is depicted. This illustration discloses a sink basin 70 used for food preparation, along with three (3) portable hose connections 75, 80, 90. A water hose connection 75 provides fresh water to the faucet 45, and is CSA low lead content certified to NSF/ANSI 372 and complies with all Federal and State level Low Lead Laws. The body of the hose is NSF certified drinking water safe, BPA free, lead free and phthalate free. A drain waste hose 80 is connected to a drain fixture 85 on the sink basin 70 and carries away waste water and associated food to an approved area such as a sanitary sewer system or a waste tank or container. A fuel hose 90 complete with a regulator 95 is used to provide fuel to the burner assembly 50. It should be noted that while the present disclosure provides for the identification of propane components, any fuel source including, but not limited to: natural gas, methane, butane, or the like could be utilized with equal effectiveness, and as such, the inclusion or exclusion of any particular fuel source should not be interpreted as a limiting factor of the present invention.

A wok-style cooking pan 100 is shown atop the wok ring 55 for purposes of illustration. The front surface of the control panel 60 is provided with a gas pilot valve 105 used for safe initial lighting of the burner assembly 50 in conjunction with a piezo electric ignition switch 110. A large gas valve handle 115 is attached to a main gas valve 120 for purposes of fine and accurate heat control and is manipulated frequently during the cooking process.

Figure 3:
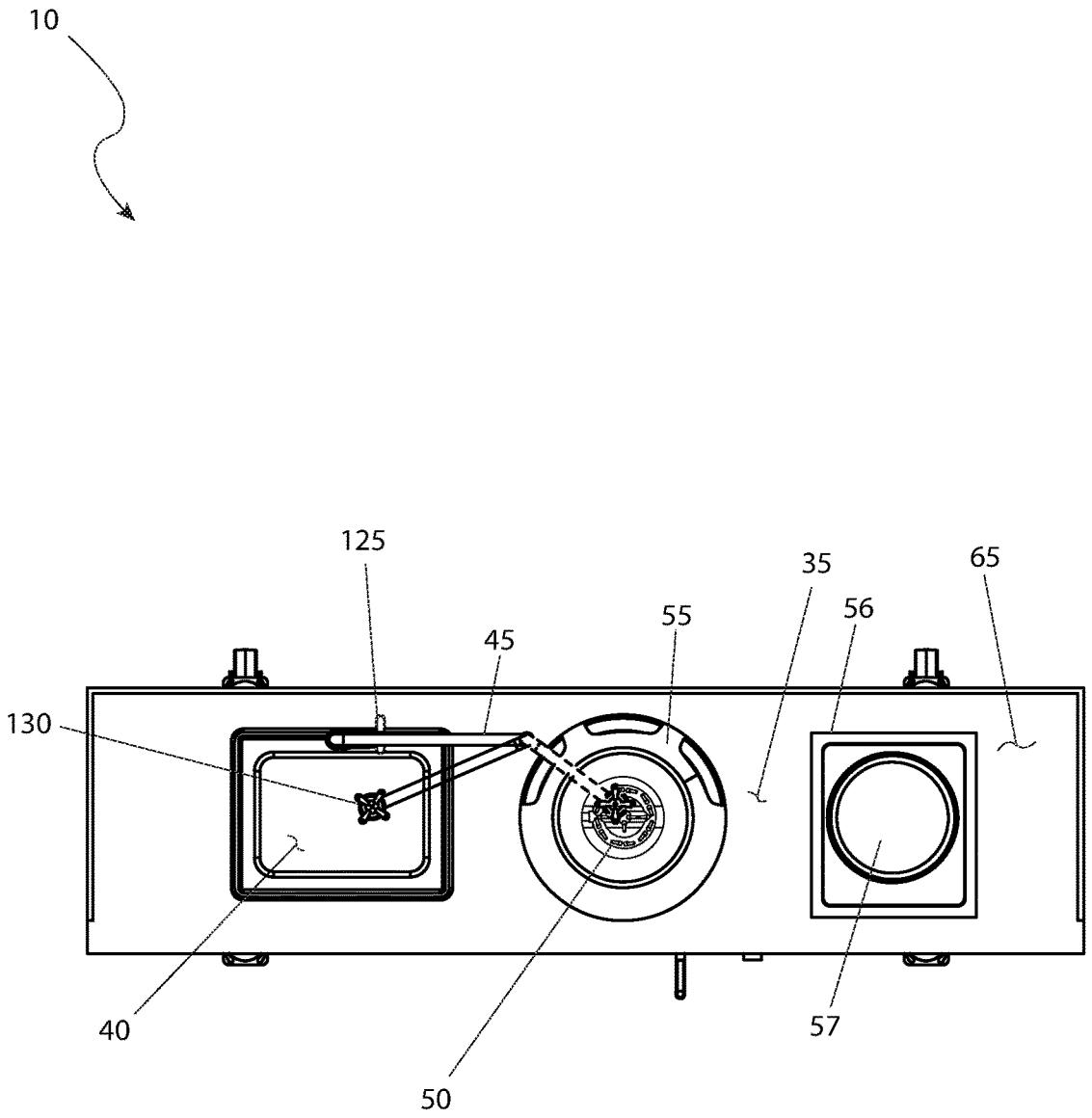
FIG. 3 is a top view of the mobile cooking wok 10, according to the preferred embodiment of the present invention.

Referring now to FIG. 3, a top view of the apparatus 10, according to the preferred embodiment of the present invention is shown. This figure provides a clear view of the sink assembly 40, the faucet 45, the burner assembly 50, the wok ring 55, and the auxiliary work surface 65, along with the relationship between each. The faucet 45 is of a folding design allowing it to be used in its retracted position as shown. It is shown in an extended position over the wok-style cooking pan 100 (not shown in this figure) via dashed line where it can be used to fill the wok-style cooking pan 100 (not shown in this figure). A primary valve 125 is used to control flow rate of a fluid delivered via the water hose connection 75 and the faucet 45, while a secondary valve 130 can be used to provide on-off control at the point of use. The primary valve 125 is commonly placed on the top edge of the basin 70 in the rear. The auxiliary work surface 65 is visible on the opposite end of the work surface 35.

Figure 4:
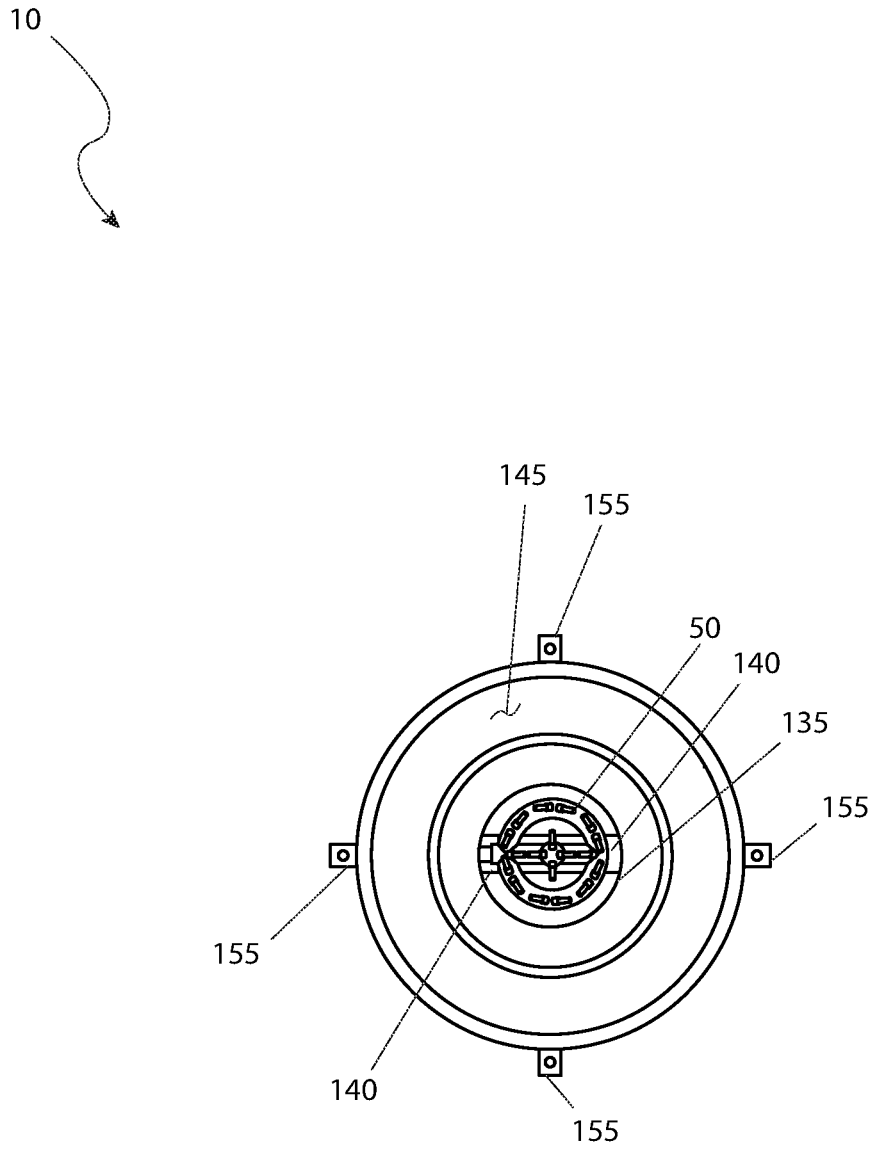
FIG. 4 is a sectional view of the mobile cooking wok 10, as seen along a line I-I, as shown in FIG. 1, according to the preferred embodiment of the present invention; and, FIG. 5 is a sectional view of the mobile cooking wok 10, as seen along a line II-II, as shown in FIG. 1, according to the preferred embodiment of the present invention.

Referring next to FIG. 4, a sectional view of the apparatus 10, as seen along a line I-I, as shown in FIG. 1, according to the preferred embodiment of the present invention is disclosed. The wok ring 55 has been removed for purposes of clarity. The burner assembly 50 is centrally located. The burner assembly 50 is of a sixteen (16) nozzle design and is equipped with a concentration cone 135 to concentrate the flame and direct them to the center of the wok-style cooking pan 100 (as shown in FIG. 1). Such an arrangement increases burner efficiency while reducing heat transfer to nearby surfaces, thus allowing for a safer and more comfortable work surface. The burner assembly 50 is supported by a mounting bar 140 which in turn physically attaches to a wok flue/chamber 145. A set of four (4) right angle clips 155 then attach the wok flue/chamber 145 to the work surface 35 to further reduce heat transfer to the work surface 35.

Figure 5:
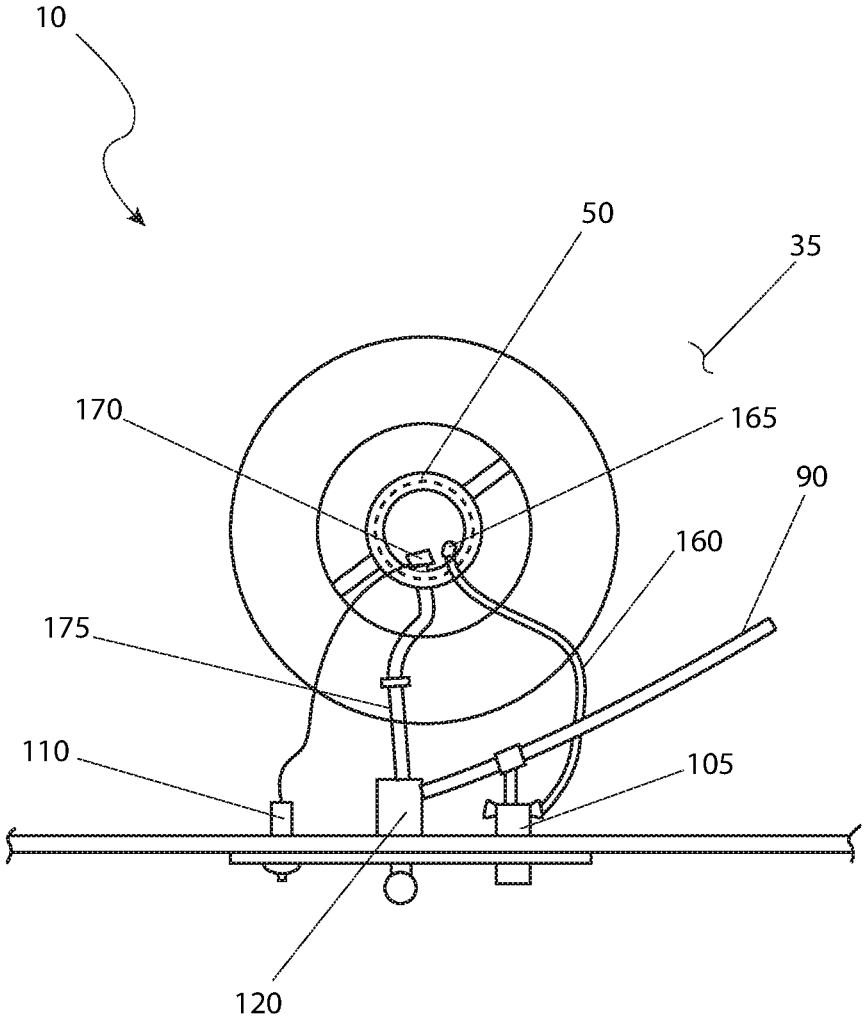

Referring finally to FIG. 5, a sectional view of the apparatus 10, as seen along a line II-II, as shown in FIG. 1, according to the preferred embodiment of the present invention is depicted. This view, looking upward from underneath the work surface 35 further discloses the propane hose 90 entering the gas pilot valve 105 and the main gas valve 120. A gas pilot supply line 160 is routed from the gas pilot valve 105 to a gas pilot orifice 165 which is used to ignite the burner assembly 50. A piezo electric striker 170 is located near the gas pilot orifice 165 and is electrically connected to the piezo electric ignition switch 110. Gas burner piping 175 is then routed from the main gas valve 120 to the burner assembly 50.

The preferred embodiment of the present invention can be utilized by the common user in a simple and effortless manner with little or no training. It is envisioned that the apparatus 10 would be constructed in general accordance with FIG. 1 through FIG. 5. The user would procure the apparatus 10 through normal channels, perhaps the same to procure other outdoor cooking and heating appliances such as propane grills, barbeque grills, patio heaters, and the like.

After procurement and prior to utilization, the apparatus 10 would be prepared in the following manner: the apparatus 10 would be placed in a suitable outdoor location using the rotatable casters 25, the water hose connection 75 would be connected to a suitable water source, the drain waste hose 80 would be connected to a suitable waste connection, and the fuel hose 90 and regulator 95 would be connected to a suitable fuel source.

During utilization of the apparatus 10, the following procedure would be initiated: the food stuffs are prepared using the auxiliary work surface 65, water is added via the faucet 45, the gas pilot orifice 165 is lit by manipulation of the gas pilot valve 105 and simultaneous pressing of the piezo electric ignition switch 110, the main gas valve 120 is manipulated to light the burner assembly 50 and the food stuffs are cooked following normal procedures with periodic manipulation of the gas valve handle 115 as necessary to control cooking temperatures.

After use of the mobile cooking wok 10, the gas pilot valve 105 and the main gas valve 120 are closed, the fuel hose 90 and regulator 95 disconnected, the drain waste hose 80 disconnected, the water hose connection 75 disconnected, the apparatus 10 generally cleaned to a sanitary condition and stored until needed again in a cyclical manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A portable cooking station, comprising:

a table assembly, comprising:

an upper table, comprising an upper first side and an upper second side;

a lower table, comprising a lower first side and a lower second side;

four first leg segments, each having a first end connected to said upper second side and each having a second end connected to said lower first side;

four second leg segments, each located immediately subjacent to an individual one of and coaligned with said four first leg segments, a first end of each second leg segment attached to said lower second side; and, a caster wheel assembly disposed on second ends of each second leg segment;

a sink assembly mounted within said upper table, comprising a basin accessible from said upper first side;

a burner assembly with a wok ring integrated therewith, mounted within said upper table and accessible from said upper first side; wherein said burner assembly is capable of producing approximately 100,000 BTS's;

a mounting plate disposed within and affixed to said upper table, comprising an open central portion;

a vessel with an open top a sidewall tapering from a first larger diameter at an upper perimeter edge to a second smaller diameter at a closed bottom, said vessel capable of nesting within and being suspended by said mounting plate; and, a control panel in electrical and fluid communication with said burner assembly, said control panel affixed to a sidewall of said upper table.

2. The portable cooking station of claim 1, wherein said first leg segment second ends and said second leg segment first ends are located at a corner of said lower table.

3. The portable cooking station of claim 1, wherein said work table further comprises a stainless steel construction.

4. The portable cooking station of claim 1, wherein each caster has 360° of rotation.

5. The portable cooking station of claim 1, wherein said sink assembly further comprises:

a faucet assembly affixed to said basin and extending upward from said upper first side; including:

a first valve;

a faucet in fluid communication with said first valve; and, a second valve located on said faucet and in fluid communication therewith;

a water supply hose configured to be in fluid communication between a water supply and said second valve;

a drain fixture located at a bottom of said basin; and, a drain hose configured to be in fluid communication with said first valve.

6. The portable cooking station of claim 5, wherein said faucet is a retractable folding faucet, capable of extension directly over said burner assembly.

7. The portable cooking station of claim 1, wherein said burner assembly further comprises:

a flue chamber capable of being removably attached to said upper first side;

a mounting bar affixed to said flue chamber;

a plurality of burner nozzles, each in fluid communication with a fuel source each capable of producing a flame, each attached to said mounting bar; and, a concentration cone, attached to said mounting bar and oriented to direct said flames from each nozzle towards a center of said ring.

8. The portable cooking station of claim 7, further comprising sixteen nozzles.

9. The portable cooking station of claim 7, wherein said control panel further comprises:

a main burner supply line in fluid communication with each burner nozzle;

a main valve in fluid communication with said burner piping;

a pilot supply line in fluid communication with each said burner nozzle, terminating in a pilot orifice;

a striker located adjacent said pilot orifice;

a piezo electric ignition switch in electrical communication with said striker;

a pilot valve in fluid communication with said pilot supply line opposite said pilot orifice;

a supply line capable of being in fluid communication between a fuel source and said main valve and said pilot valve; and, a regulator in fluid communication with said supply line.

* * * * *